US006918575B2

(12) United States Patent
Cadrain et al.

(10) Patent No.: US 6,918,575 B2
(45) Date of Patent: Jul. 19, 2005

(54) VEHICLE TILTING SYSTEM

(76) Inventors: Tony P. Cadrain, P.O. Box 37, Rocky Mountain House, AB (CA), T4T 1A1; Donald Sands, Box 6 Ste. 3 RR#2, Rocky Mountain House, AB (CA), T4T 2A2

( * ) Notice: Subject to any disclaimer, the term of this patent is extended or adjusted under 35 U.S.C. 154(b) by 57 days.

(21) Appl. No.: 10/421,764

(22) Filed: Apr. 24, 2003

(65) Prior Publication Data

US 2004/0211947 A1 Oct. 28, 2004

(51) Int. Cl.[7] ..... E02C 3/00
(52) U.S. Cl. ..... 254/88; 254/90; 254/93 HP
(58) Field of Search ..... 414/678; 14/71.1; 254/88, 90, 93 HP

(56) References Cited

U.S. PATENT DOCUMENTS

| | | | | | |
|---|---|---|---|---|---|
| 1,525,447 | A | | 2/1925 | Hose | |
| 1,844,584 | A | | 2/1932 | Manley | |
| 1,973,014 | A | | 9/1934 | Oglesby | |
| 1,973,803 | A | | 9/1934 | Frauen | |
| 2,135,765 | A | | 11/1938 | Paine | |
| 3,818,579 | A | | 6/1974 | Pietrelli et al. | |
| 3,931,895 | A | * | 1/1976 | Grimaldo | 414/678 |
| 4,572,579 | A | * | 2/1986 | Saito | 298/1 A |
| 5,478,191 | A | | 12/1995 | Rober | |
| 5,542,806 | A | * | 8/1996 | Kang | 414/422 |
| 5,600,859 | A | | 2/1997 | Hodges et al. | |
| 5,651,155 | A | | 7/1997 | Hodges et al. | |
| 5,794,907 | A | * | 8/1998 | Bellia | 248/354.7 |

* cited by examiner

*Primary Examiner*—Robert C. Watson
(74) *Attorney, Agent, or Firm*—Borden Ladner Gervais LLP

(57) ABSTRACT

A vehicle tilting system for tilting a vehicle to expose the vehicle's undercarriage is disclosed. More specifically, the present system includes a vehicle support frame pivotally connected to a supporting surface. The vehicle support frame supports a vehicle and pivots between a collapsed position and an inclined position upon inflation of an inflatable air bag system that is connected to and placed between the supporting surface and the vehicle support frame.

19 Claims, 6 Drawing Sheets

100
16
16b
16a
12
14
10
20
40
41
60
30
13
15

VEHICLE TILTING SYSTEM

FIELD OF THE INVENTION

The present invention provides a system for tilting a vehicle for exposing the undercarriage of the vehicle for washing or repairing the vehicle or for emptying out the back of the vehicle. More specifically, the present system includes a base frame and a vehicle support frame that is pivotally connected to the base frame. The vehicle support frame supports a vehicle and pivots from a collapsed position to an inclined position upon inflation of an inflatable air bag system connected to the base frame and the vehicle support frame between the base frame and the vehicle support frame.

BACKGROUND OF THE INVENTION

In the automotive industry, various systems have been developed to enable access to the underside of a vehicle for a variety of purposes including viewing, washing or fixing the underside of the vehicle. In the past, such systems have typically been either horizontal lifting systems that lift a vehicle from a supporting surface or open pit systems that allow access to the underside of the vehicle from below the supporting surface. Other systems, such as vehicle tilting systems have not been utilized because of the limited access to the entire underside of the vehicle for viewing or fixing the vehicle as well as other issues such as the complexity of operation and the safety issues associated with properly securing a vehicle to a tilting frame.

However, one particular use of a vehicle lifting system where limited access to the underside of the vehicle is particularly desirable is for washing the underside of the vehicle. Traditional car washes including both automatic car washes and manual car washes do not readily enable the underside of the vehicle to be washed. For many vehicle owners, particularly those vehicle owners whose vehicles are driven off-road, the need to have improved access to the underside of the vehicle is necessary to ensure that the vehicle has been properly cleaned of potentially damaging substances such as salt and sand.

However, past vehicle lifting systems are unsuitable for this use primarily due to the cost of installation, issues with respect to the use of such systems in a harsh cleaning environment as well as issues with respect to the operation of such systems by the public. In the case of open pits, the danger of falling into such areas or access to such areas has prevented the adoption of open pits in a car wash environment. Furthermore, both these types of systems are disadvantaged by the manner in which cleaning fluids drip from the vehicle where systems that keeps a vehicle in a horizontal position are more inconvenient as they are more likely to have fluids drip onto the user.

As a result, there has been a need for a vehicle tilting system that can withstand a car wash environment and that is also safe to operate while providing proper access to the underside of the vehicle for cleaning. In particular, there is a need for a system that lessens the likelihood of cleaning fluids dripping or falling back on top of the user.

Still further, many tilting systems rely on mechanisms such as pneumatic cylinders or jacks or hydraulic hoists which are generally not suitable within harsh cleaning environments as the mechanisms may be damaged when exposed to environmental elements such as dirt, grit, sand, salt and cleaning substances including soaps and water.

Some examples of the prior art discussed above can be found in U.S. Pat. Nos. 1,525,447, 1,844,584 and 1,973,014 which provide various devices for lifting or tilting vehicles, none of which are suitable for the purposes of the present invention. Other systems such as dock leveler devices (as taught in U.S. Pat. Nos. 5,600,859 and 5,651,155) relate to tilting systems, requiring a pit.

Accordingly, there is a need for a vehicle tilting system which can provide adequate support and stability for a vehicle, operate without a pit and provide a mechanism for tilting the vehicle which is suitable for use in harsh environments.

SUMMARY OF THE INVENTION

In accordance with the invention, there is provided a vehicle tilting system comprising: a vehicle support frame pivotally connected to a supporting surface, the vehicle support frame for supporting a vehicle and for pivotal movement between a collapsed position and an inclined position; and at least one inflatable air bag system operatively connected to the supporting surface and the vehicle support frame for moving the vehicle support frame from the collapsed position to the inclined position upon inflation of the airbags.

In a more specific embodiment, the invention provides a vehicle tilting system comprising left and right tracks each pivotally connected to a base frame, the left and right tracks for supporting a vehicle and for coordinated pivotal movement between a collapsed position and an inclined position; and, at least one inflatable air bag system operatively connected to the base frame and each of the left and right tracks for moving the left and right tracks jointly from the collapsed position to the inclined position upon inflation of the airbags.

In a still further embodiment, the invention provides a vehicle tilting system. comprising: co-joined left and right tracks each pivotally connected to a base frame having adjustable wheel stops, the left and right tracks for supporting a vehicle and for securing the vehicle with the adjustable wheel stops and for coordinated pivotal movement between a collapsed position and an inclined position; left and right support members pivotally connected to each of the left and right tracks, between the base frame and the respective left and right tracks for respectively supporting at least one air bag between each of the left and right support members and the base frame and at least one air bag between each of the left and right support members and the left and right tracks; and left and right safety supports pivotally connected to each of the left and right tracks and respectively slidably engageable with a left and right support leg track in the base frame, the left and right support leg tracks in the base frame having a plurality of stops for receiving the left and right safety supports in a plurality of engaged positions for providing support to the left and right tracks when the left and right tracks are in an inclined position.

BRIEF DESCRIPTION OF THE DRAWINGS

The invention is described by reference to the accompanying drawings wherein.

DETAILED DESCRIPTION OF THE INVENTION

Figures 1, 2, 3:
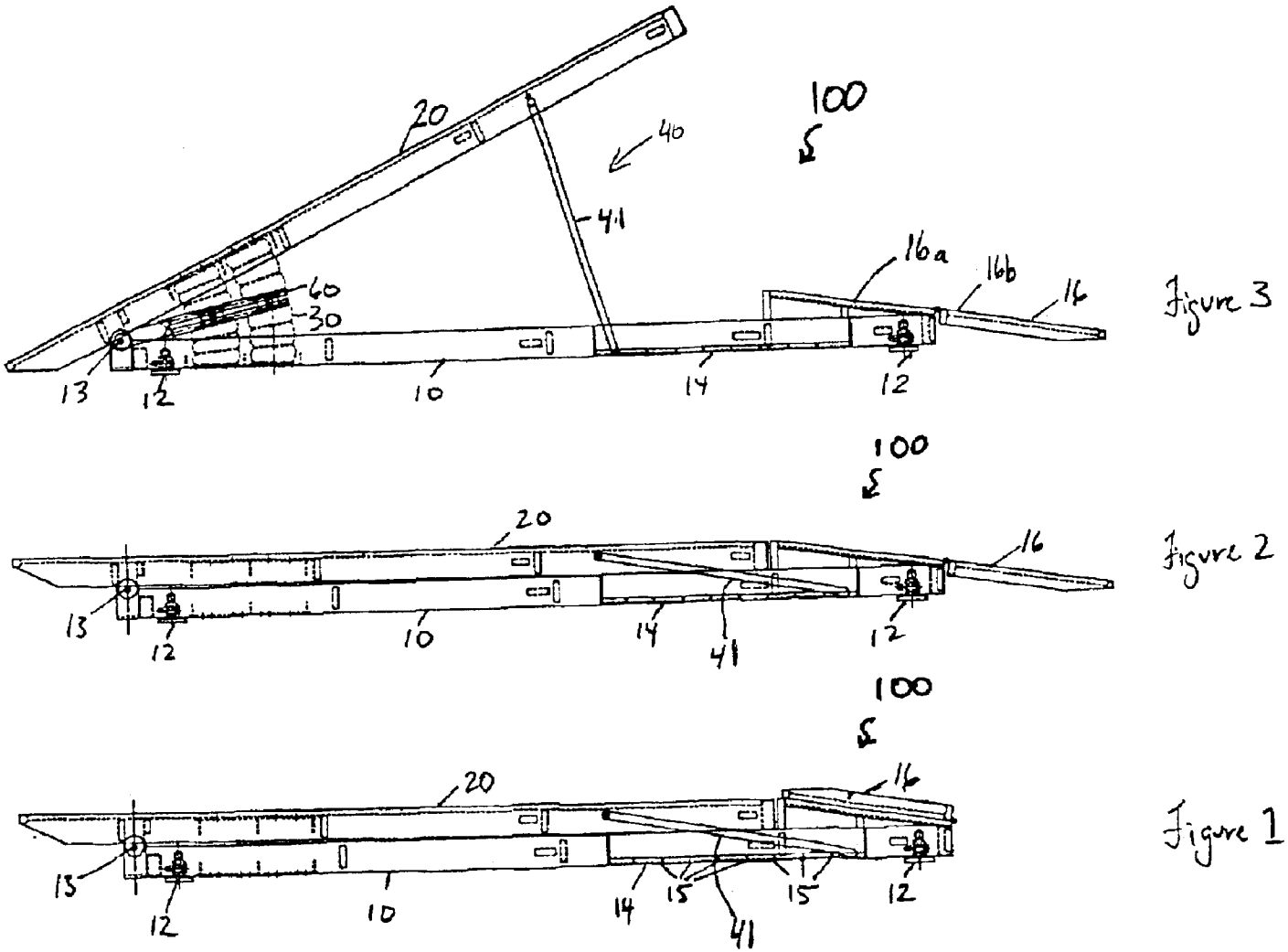
FIG. 1 is a side view of a vehicle tilting system in a collapsed position in accordance with the invention.
FIG. 2 is a side view of a vehicle tilting system in a collapsed position with a ramp extended in accordance with the invention.
FIG. 3 is a side view of a vehicle tilting system in an inclined position with air bags fully inflated and a safety support system in a fully engaged position in accordance with the invention.

With reference to the figures, a vehicle tilting system 100 is described. The vehicle tilting system 100 generally includes a base frame 10 and a vehicle support frame 20 for supporting a vehicle. The vehicle support frame 20 is pivotally connected to the base frame 10 and includes at least one inflatable air bag system 30 connected to the base frame 10 and the vehicle support frame 20.

In general operation, a vehicle (not shown) is driven or rolled on to the vehicle support frame 20. A user inflates air bags 30 which apply a lifting pressure against vehicle support frame 20 thereby tilting the vehicle support frame and vehicle with respect to the base frame 10. At the desired level of inclination, the air supply to the air bags 30 is cut off and the vehicle support frame may be secured in the inclined position by a locking system 40 thus permitting a user to perform the desired operation on the tilted vehicle. Upon completion of the desired operations, the locking system is deactivated and air from the air bags is bled out thereby returning the vehicle to a horizontal position allowing the vehicle to be removed from the vehicle support frame.

More specific embodiments and modes of operation are described below.

Base Frame 10

With reference to FIGS. 1, 2, 3 and 3A, base frame 10 provides support for the vehicle tilting system. Base frame 10 is preferably constructed of steel or iron or any other suitable heavy as would be known to those skilled in the art to provide appropriate strength and stability to the system 100.

Figure 3A:
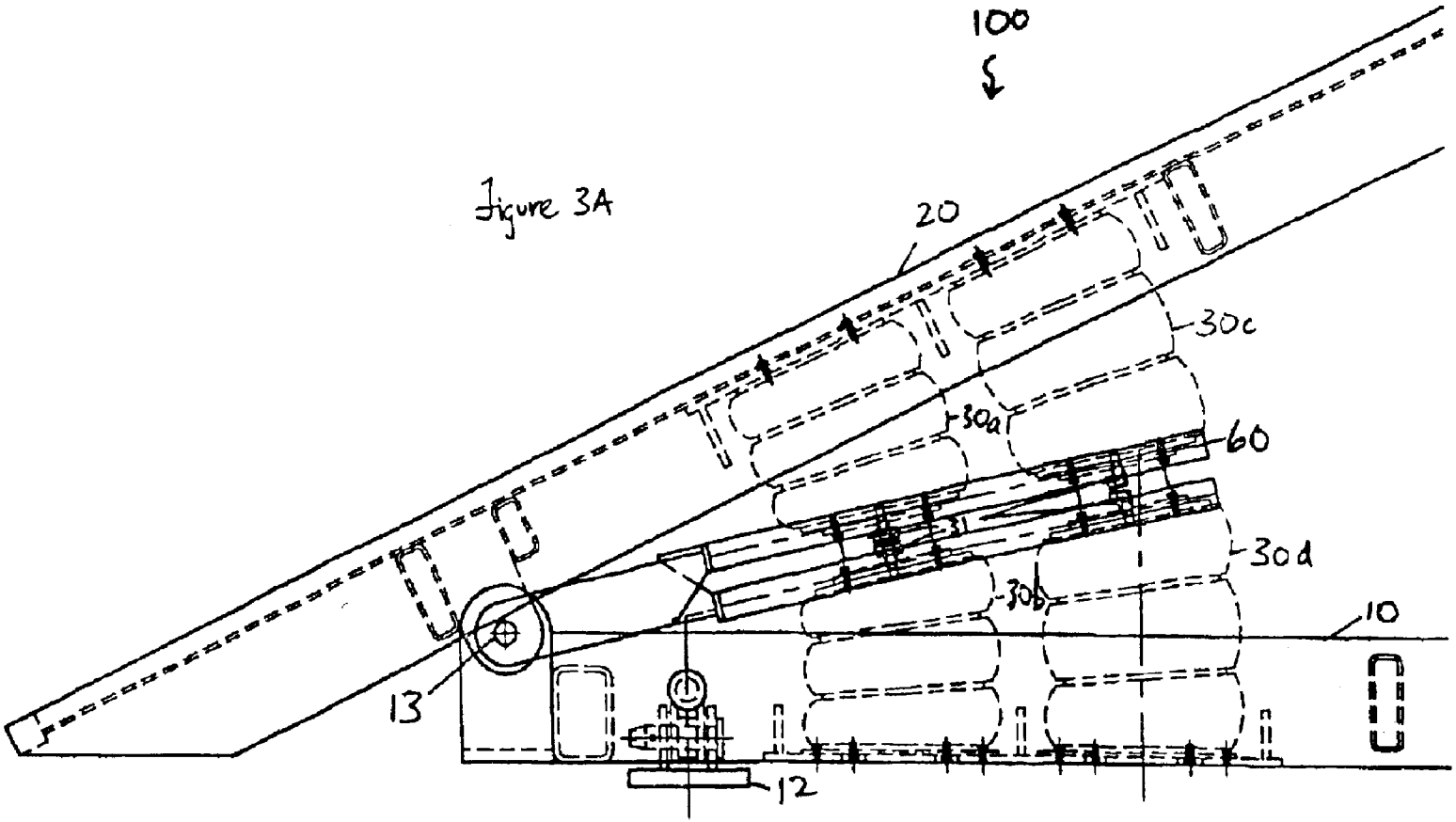
FIG. 3A is an enlarged side view of the vehicle tilting system shown in FIG. 3 in an inclined position with air bags fully inflated in accordance with the invention.

Base frame 10 includes a pivot 13 which operatively connects base frame 10 to vehicle support frame 20 and enables pivotal movement of vehicle support frame 20 between a collapsed position as shown in FIGS. 1 and 2 and an inclined position as shown in FIGS. 3 and 3A.

The system may also include a ramp 16 for providing an even rolling surface enabling vehicles to smoothly access vehicle support frame 20 from the ground. Ramp 16 is preferably attached to base frame 10. In one embodiment, ramp 16 has both a fixed member 16*a* and a hinged member 16*b* pivotally connected to base frame 10 wherein the hinged member may be retracted and locked over fixed member 16*a* for storage or shipping of the system 100 or to prevent unauthorized use of the system.

Base frame 10 may also include legs or stools 12 for keeping system 100 off the ground for preventing exposure of the system to water and dirt and for facilitating cleaning of the system. Additionally, stools 12 may be adjustable for adjusting the height of base frame 10 when the vehicle tilting system is placed on uneven ground or deliberately on an uneven grade for the purpose of drawing water and debris away from system 100.

While it is preferred that the system is provided with base frame 10 to allow portability of the system, it is also understood that the base frame may be any supporting surface such as a concrete floor or other work surface to which a vehicle support frame is pivotally connected.

Vehicle Support Frame 20

With reference to FIGS. 1, 2, 3 and 3A, vehicle support frame 20 supports the vehicle whilst the vehicle is on the system.

Figure 4:
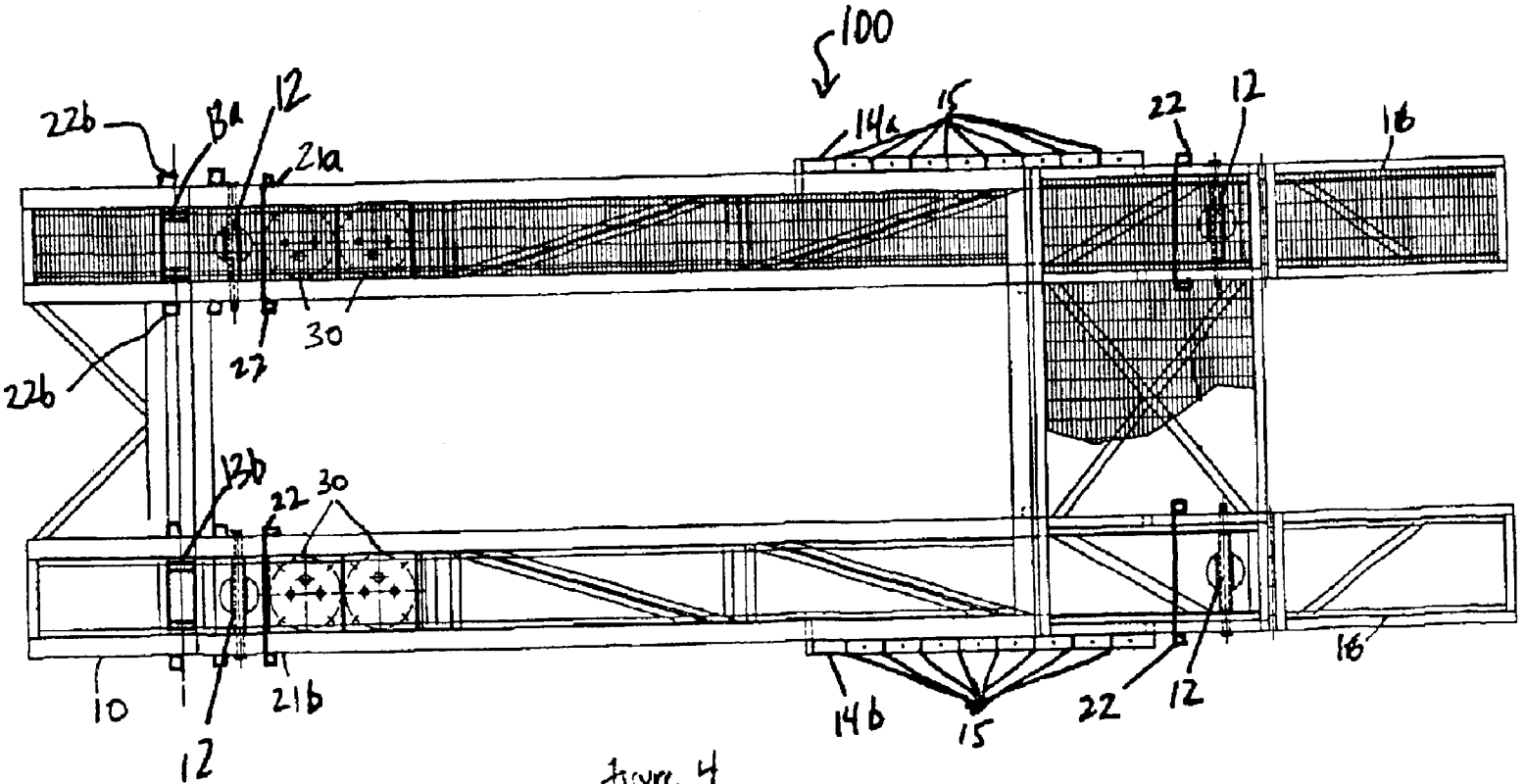
FIG. 4 is a top view of a vehicle tilting system in a collapsed position with a ramp extended in accordance with the invention.

In one embodiment, as shown in FIG. 4, vehicle support frame 20 includes left 21*a* and right 21*b* tracks for respectively receiving the left and right tires of the vehicle and for supporting the vehicle in conjunction with wheel stop system 22. In this embodiment, a left pivot 13*a* and a right pivot 13*b* are provided for each of the respective left track 21*a* and right track 21*b*. Tracks 21*a* and 21*b* are preferably constructed from durable grating such as steel or iron grating to allow maximum exposure of the supported vehicle's undercarriage to sprayed water, to allow drainage of water away from the system and to enhance the grip between a vehicle's tires and system 100 while providing sufficient structural strength to support a vehicle.

Figure 4A:
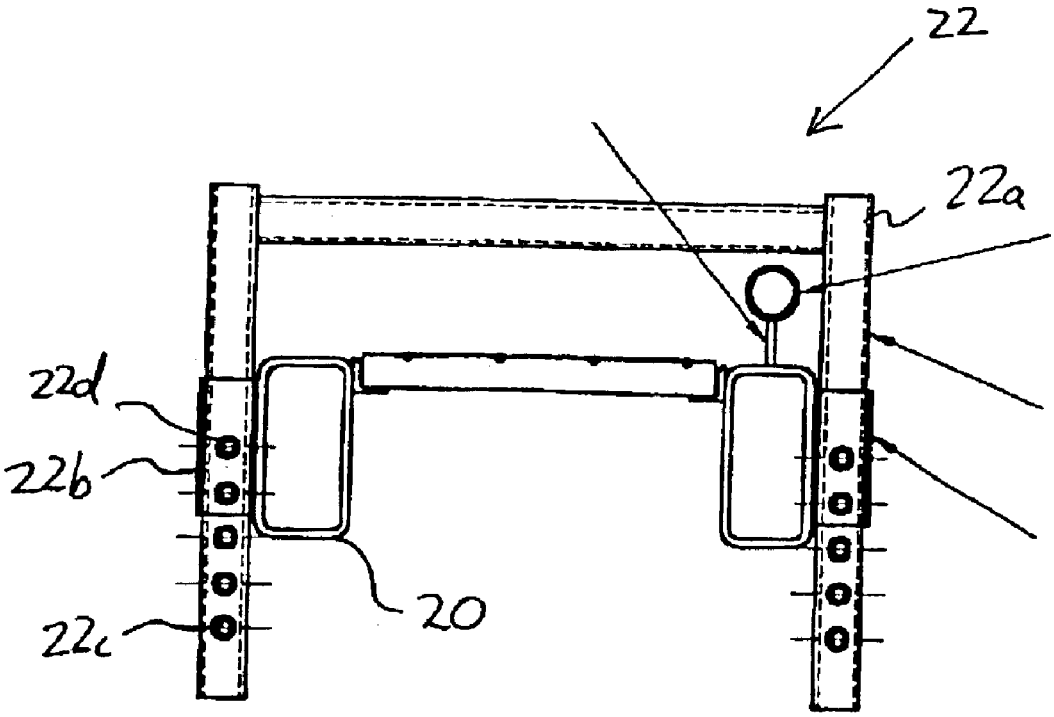
FIG. 4A is an end view of the frame of a vehicle tilting system in accordance with the invention showing details of the wheel stop.

In another embodiment, shown in FIGS. 4 and 4*a*, tracks 21*a* and 21*b* include a plurality of adjustable wheel stops 22*a* for preventing movement of the vehicle once the vehicle is driven or rolled onto tracks 21*a* and 21*b*. The wheel stops are preferably designed to accommodate different wheel sizes. With reference to FIG. 4*a*, a wheel stop 22*a* is preferably a u-shaped bracket that may be placed within different wheel stop sleeves 22*b* located at different locations along the frame 20. Both the wheel stop 22*a* and wheel stop sleeves 22*b* may be provided with respective holes 22*c* and 22*d* to allow height adjustment of the wheel stop 22*a* with respect to the frame 20.

Air Bag System 30

With reference to FIGS. 1, 2, 3 and 3A, inflatable air bags 30 are operatively connected or tethered to base frame 10 and vehicle support frame 20. The air bag system is used to move vehicle support frame 20 from the collapsed position (FIGS. 1 and 2) to the inclined position (FIGS. 3 and 3A). More specifically, upon inflating air bags 30, air bags 30 apply a lifting pressure against vehicle support frame 20 thereby tilting vehicle support frame 20 and the vehicle with respect to base frame 10 until airbags 30 are fully inflated. Air bags 30 are constructed of materials known by those skilled in the art to be resilient to environmental elements such as dirt, grit, sand, salt, soaps and water as well as being easily cleaned.

In one embodiment, as best shown in FIGS. 3 and 3A, system 100 includes at least one support member 60 connected to base frame 10 at pivot 13 for supporting a number of separate air bags. As shown, a first air bag 30*a* is located between support member 60 and vehicle support frame 20 and a second air bag 30*b* is supported between support member 60 and base frame 10. The use of support member 60 allows effective stacking of separate air bags to ensure proper alignment of the air bags upon expansion and collapse of multiple air bags.

In a further embodiment, also shown in FIGS. 3 and 3A, the air bag system may also include additional air bags adjacent air bags 30*a*, 30*b*. As shown, a third air bag 30*c* is located adjacent air bag 30*a* and a fourth air bag is located adjacent air bag 30*b* on respective sides of the support member 60. The use of additional air bags may be required to increase the load which may be supported upon inflation of air bags 30 (that is, for supporting heavier vehicles upon inclining vehicle support frame 20).

Figure 5:
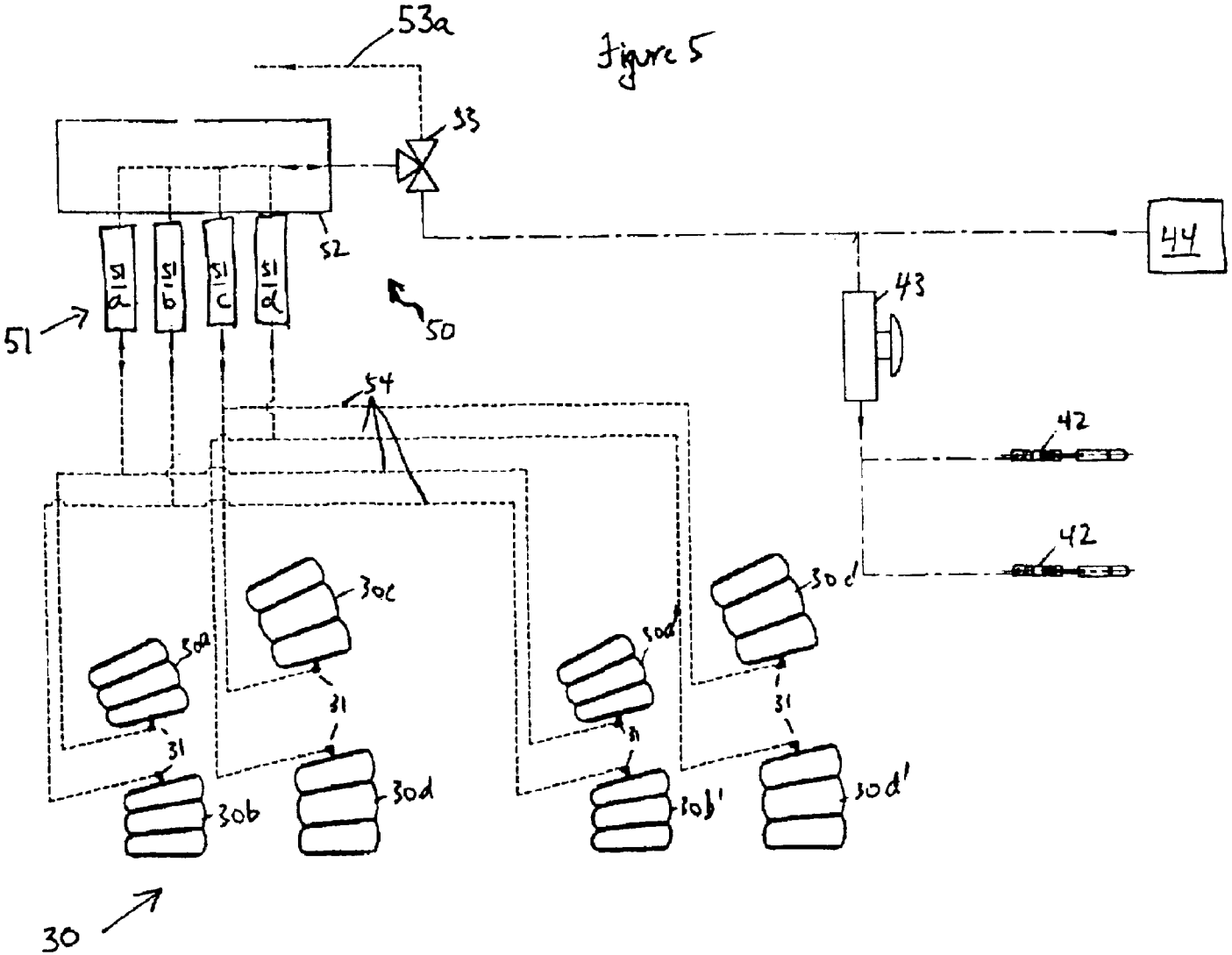
FIG. 5 is a schematic view of a valve system used to inflate and deflate air bags in accordance with the invention.

In another embodiment as best shown in FIG. 5, the air bag system includes at least one set of air bags 30 for each of left track 21*a* and right track 21*b* respectively. More specifically, the air bag system may include air bags 30*a*', 30*b*', 30*c*' and 30*d*' as shown in FIG. 5 for each of left track 21*a* and right track 21*b*. Further, support member 60 may include a separate left and right support member (not shown) for respectively connecting to the left and right sets of air bags 30 at left pivot 13*a* and right pivot 13*b*. A worker skilled in the art will recognize that any combination of air bags 30 with vehicle support frame 20 or individual tracks 21*a* and 21*b* and a plurality of support members 60 may be used for safely moving the vehicle support frame between the collapsed and inclined positions.

In another embodiment, double or triple billows air bags may be used to increase the degree of inclination of the ramp when air bags 30 are inflated and for providing additional stability to the air bag system. A worker skilled in the art will recognize that different numbers of billows will be suitable for different desired maximum heights, for reducing misalignment problems upon inflating the air bags and for providing maximum stability and safety.

Air bags 30 generally include an air bag connector 31 for interfacing the air bags to an air supply 44 and control system 50 as shown in FIG. 5 for controlling the inflation and deflation of air bags 30.

The control system 50 generally includes a manifold 52, a three-way valve 53 operatively connected to the manifold and excess flow check valves 51. The three-way valve is used to control air flow from for an air supply 44 to the manifold during air bag inflation and from the manifold to exhaust 53*a* during air bag deflation. The manifold directs air supply to the respective air bags through excess flow check valves 51 and hoses 54. As shown in FIG. 5, corresponding sets of air bags may be connected to one excess flow check valve 51. For example, corresponding left side and right side air bags 30*a*, 30*a*' may be connected to excess flow check valve 51*a*. Manifold exhaust 53*a* is a calculated and controlled air bleed off, calculated from the air flow rates of the excess flow valves used. Excess flow check valves 51 operate to prevent collapse of the entire air bag system in the event of a failure of one air bag within the system. For example, in the event of failure of one air bag or hose, the excessive air flow through the excess flow check valve towards the failed air bag or hose will cause the other check valves to close thereby stopping the exhaust of the remaining air bags and isolating the failed air bag or hose.

Safety Support 40

In a preferred embodiment, a safety support system 40 is integrated to the vehicle support frame 20 and the base frame 10 for preventing the sudden collapse of vehicle support frame 20 if the air bags 30 fail and to support the system in an inclined position. The safety support system 40 includes a support leg track 14 having a plurality of stops 15 placed at various positions along support leg track 14 within the base frame 10 and a support leg 41 pivotally connected to the vehicle support frame 20 as is shown in FIGS. 1–3, 6A and 6B. In another embodiment, the safety support system 40 may be connected to base frame 10 and slidably moveable within vehicle support frame 20.

During operation, and upon inflating air bags 30 to incline the vehicle support frame 20, support leg 41 slides along support leg track 14 and over stops 15. At any time while inclining the vehicle support frame 20, the safety support system 40 acts as a failsafe such that if vehicle support frame 20 suddenly collapses as a result of an air bag failure, the safety support leg 41 will engage with the nearest stop 15 and thereby lock vehicle support frame 20 at that position. Furthermore, and during preferred operation, once vehicle support frame 20 is in the fully inclined position, the safety support system 40 is engaged (with air bags partially deflated) while a user is working beneath the vehicle.

In another embodiment, the safety support system 40 includes a support leg 41 for each of left track 21*a* and right track 21*b* where base frame 10 includes respective support leg tracks 14*a* and 14*b* along each of the left and right sides of the base frame 10.

Figures 6A, 6B:
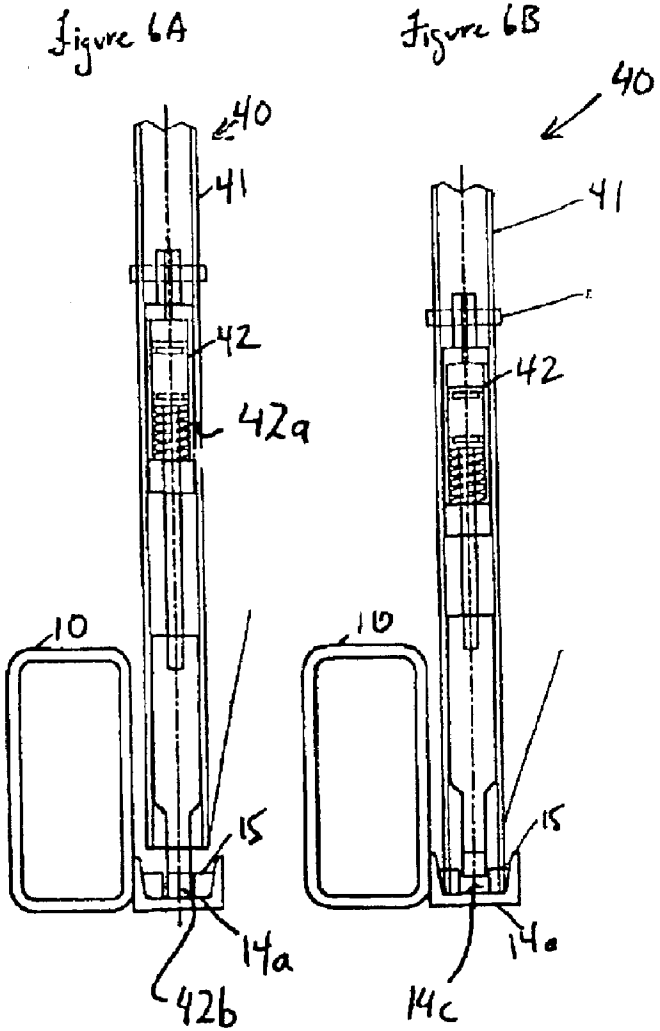
FIGS. 6A and 6B are sectional side views of a safety support system in accordance with the invention.

In another preferred embodiment, as shown in FIGS. 6A and 6B, it is preferred that each leg track 14*a* and 14*b* has a flat center track 14*c* and the safety support leg 41 includes a spring loaded air cylinder 42 having spring 42*a* operatively connected to release leg 42*b*. FIG. 6A shows the release leg 42*b* in an extended position whereby the support leg 41 is in a lifted and disengaged position with respect the stops 15 within track 14*a* whereas FIG. 6B shows the support leg 41 in a lower or retracted position where the release leg is engaged with a stop 15 within track 14*a*. Pressuring air cylinder 42 extends release leg 42*b* with respect to support leg 41 against spring 42*a* and de-pressuring air cylinder 42 causes spring 42*a* to retract the release leg 42*b* with respect to the support leg 41. It is preferred that air cylinder 42 includes at least one orifice (not shown) to continuously bleed pressure from the cylinder such that any cessation of air flow into air cylinder 42 causes an immediate retraction of release leg 41.

As shown in FIG. 5, the control system also includes a retraction valve 43 to direct pressured air from air supply 44 to air cylinder 42. The retraction valve is preferably opened against a spring (not shown) such that a pressure must be maintained against the valve 43 to keep the valve open and air flowing through the valve 43 wherein a release of pressure on the valve 43 will cause the spring to close the valve immediately.

In operation, system 100 is in a collapsed position as shown in FIG. 1. Ramp 16, if present, is extended as shown in FIG. 2 for allowing a vehicle to be driven or rolled onto vehicle support frame 20. Once the vehicle is secured on vehicle support frame 20 using wheel stops 22, an operator may begin to incline vehicle support frame 20 by inflating air bags 30.

The air bags 30 are inflated using control system 50. The operator opens three way valve 53 to direct high pressure air from the air supply 44 through manifold 52, check valves 51 and into the air bags 30 causing the vehicle support frame 20 to tilt.

As the vehicle support frame 20 tilts, the safety support system 40 slides along support leg track 14 and progressively engages stops 15. After the vehicle support frame is at the desired level of inclination, three way valve 53 is closed allowing air from the air bags 30 to bleed through exhaust 53*a* which causes safety support system 40 to firmly engage on the last engaged stop 15 to hold the vehicle support frame at the desired inclination.

The vehicle is returned to horizontal by turning three-way valve 53 back to re-inflate the air bags to remove pressure between the support leg 41 and the engaged stops 15. The user then depresses release valve 43 to direct air into air cylinders 42 thereby causing release leg 42*b* to extend and thus fully disengage the safety support leg 40 from the stops 15. While holding release valve 43 in the depressed position, the user closes three-way valve 53 allowing air from the air bags 30 to bleed through exhaust 53*a* such that the air bags deflate and the safety support leg 40 slides back along tracks 14*a*, 14*b*. The rate of descent of the vehicle support frame can be controlled by valve 53. In the event of a failure of the air bag system, the user can immediately withdraw pressure from the release valve 53 thereby cutting off air supply to cylinder 42 which will cause release leg 42*b* to collapse and support leg 41 to engage with the nearest stop 15.

It is understood that various embodiments of the system can be developed departing from the spirit of the invention.

What is claimed is:

1. A vehicle tilting system comprising:

a vehicle support frame having a substantially open longitudinal central opening, pivotally connected to a supporting surface at a pivot, the vehicle support frame for supporting a vehicle and for pivotal movement between a collapsed position and an inclined position; and at least one inflatable air bag system generally proximate to the pivot operatively connected to the supporting surface and the vehicle support frame for moving the vehicle support frame from the collapsed position to the inclined position upon inflation of the inflatable air bag system.

2. A vehicle tilting system as in claim 1 wherein the supporting surface is a base frame.

3. A vehicle tilting system as in claim 1 wherein the vehicle support frame includes a left track for receiving the vehicle's left wheels and a right track for receiving the vehicle's right wheels.

4. A vehicle tilting system as in claim 3 wherein the air bag system includes at least one air bag for the left track and at least one air bag for the right track.

5. A vehicle tilting system as in claim 3 wherein the left and right tracks include wheel stops for preventing movement of the vehicle once the vehicle is on the left and right tracks.

6. A vehicle tilting system as in claim 1 wherein the air bag system has a plurality of bellows for increasing the degree of inclination of the vehicle support frame.

7. A vehicle tilting system as in claim 3 wherein the vehicle tilting system includes a left support member and a right support member wherein the left and right support members are pivotally connected to the supporting surface for respectively supporting at least one air bag above and at least one air bag below the right track and at least one air bag above and at least one air bag below the left track.

8. A vehicle tilting system as in claim 1 wherein the vehicle lifting system includes a safely support leg pivotally connected to the vehicle support frame and slidably and lockably engageable with the supporting surface for providing safety support for the vehicle support frame in the inclined position.

9. A vehicle tilting system as in claim 8 wherein the supporting surface includes a support leg track having a plurality of stops for receiving the safety support leg in a plurality of engaged positions when the vehicle support frame is moving into an inclined position and for preventing a sudden collapse of the vehicle support frame upon failure of the air bag system.

10. A vehicle tilting system comprising left and right tracks, being spaced apart to form a substantially open longitudinal central opening, each track pivotally connected to a base frame at a pivot, the left and right tracks for supporting a vehicle and for coordinated pivotal movement between a collapsed position and an inclined position; and, at least one inflatable air bag system generally proximate to the pivot operatively connected to the base frame and each of the left and right tracks for moving the left and right tracks jointly from the collapsed position to the inclined position upon inflation of the airbags.

11. A vehicle tilting system as claim 10 wherein the left and right tracks include adjustable wheel stops for preventing rolling movement of the vehicle on the left and right tracks.

12. A vehicle tilting system as in claim 8 wherein the safety support leg includes a spring-loaded air cylinder for disengaging the safety support leg from the support leg track.

13. A vehicle tilting system as in claim 4 wherein the air bags are operatively connected to a valve system for allowing an operator to inflate and deflate the air bags for moving the vehicle support frame from the inclined position to the collapsed position.

14. A vehicle tilting system as in claim 13 wherein the valve system includes an excess flow check valve operatively connected to each air bag.

15. A vehicle tilting system as an claim 14 wherein each excess flow check valve is operatively connected to a manifold and wherein the manifold is operatively connected to an air supply through a three-way valve for controlling airflow to and from the air bags.

16. A vehicle tilting system as in claim 2 wherein the base frame includes a hinged ramp for providing an inclined surface between a supporting surface and the vehicle support frame.

17. A vehicle tilting system as in claim 2 wherein the base frame has adjustable legs enabling adjustment of the base frame level with respect to a supporting surface.

18. A vehicle tilting system as in claim 13 further comprising a safety support leg pivotally connected to the vehicle support frame and slidably and lockably engageable with the supporting surface for providing safety support for the vehicle support frame in the inclined position, the safety support leg including a spring-loaded air cylinder for disengaging the safety support leg from the support leg track and a release valve operatively connected to the air cylinder wherein activation of the release valve disengages the safety support leg from the support leg track and wherein release of the release valve causes air to bleed from the air cylinder and the support leg to engage with the support leg track.

19. A vehicle tilting system comprising:

co-joined left and right tracks, being spaced apart to form a substantially open central opening, each track pivotally connected to a base frame at a pivot, having adjustable wheel stops, the left and right tracks for supporting a vehicle and for securing the vehicle with the adjustable wheel stops and for coordinated pivotal movement between a collapsed position and an inclined position;

left and right support members pivotally connected to each of the left and right tracks, between the base frame and the respective left and right tracks for respectively supporting at least one air bag generally proximate to the pivot between each of the left and right support members and the base frame and at least one air bag generally proximate the pivot between each of the left and right support members and the left and right tracks; and left and right safety supports pivotally connected to each of the left and right tracks and respectively slidably engageable with a left and right support leg track in the base frame, the left and right support leg tracks in the base frame having a plurality of stops for receiving the left and right safety supports in a plurality of engaged positions for providing support to the left and right tracks when the left and right tracks are in an inclined position.

* * * * *